United States Patent [19]

Loewenschuss

[11] 4,162,229

[45] Jul. 24, 1979

[54] DECONTAMINATION PROCESS

[75] Inventor: Hana Loewenschuss, Stilli, Switzerland

[73] Assignee: Gesellschaft zur Förderung der Forschung an der Eidgenössischen Technischen Hochschule, Zurich, Switzerland

[21] Appl. No.: 785,765

[22] Filed: Apr. 7, 1977

[30] Foreign Application Priority Data

Apr. 7, 1976 [CH] Switzerland ..... 4335/76

[51] Int. Cl.[2] ..... G21F 9/28

[52] U.S. Cl. ..... 252/301.1 W; 134/2; 134/3; 134/28; 134/29; 252/80; 252/86

[58] Field of Search ..... 252/301.1 W, 80, 86; 134/2, 3, 28, 29

[56] References Cited

U.S. PATENT DOCUMENTS

| | | | |
|---|---|---|---|
| 3,449,163 | 6/1969 | Mobius et al. | 134/3 |
| 3,549,419 | 12/1970 | Stiles | 134/2 |
| 3,873,362 | 3/1975 | Mihram et al. | 252/301.1 W |

OTHER PUBLICATIONS

Chem. Abstracts, 75:14137q (1971).
Chem. Abstracts, 71:93950p (1969).

*Primary Examiner*—Benjamin R. Padgett
*Assistant Examiner*—Deborah L. Kyle
*Attorney, Agent, or Firm*—Blanchard, Flynn, Thiel, Boutell & Tanis

[57] ABSTRACT

Radioactive contaminants are removed from metal surfaces by treating the metal surfaces with an aqueous solution containing cerium (IV) salt.

19 Claims, No Drawings

DECONTAMINATION PROCESS

BACKGROUND OF THE INVENTION

1. Field of the Invention

The invention concerns a decontamination process for detaching or dissolving a contamination layer covering a metallic surface, which layer contains the corrosion products of the metal in question and/or substances which have come into contact with the metallic surface or the contamination layer and have been deposited or absorbed or adsorbed there and/or substances that have diffused through the metal to the metal surface and/or chemical transformation or decomposition products of the said substances, by single or multiple dissolving-off with oxidising and/or reducing solutions, particularly for the decontamination of metallic surfaces in coolant circuits of nuclear reactors or technical devices coupled thereto and having coolant flowing through them, as well as to the use of this process for chromium and/or cobalt containing metals.

2. Description of the Prior Art

Decontamination processes of this type are known, e.g. from the textbook by J. A. Ayres, "Decontamination of Nuclear Reactor and Equipment", Ronald Press Co., New York 1970, wherein several processes used hitherto for decontaminating nuclear reactors and associated devices are described in detail as regards their mode of operation and special areas of application.

For the decontamination of water-cooled nuclear reactors built in the main from steel, the so-called "AP-Citrox" process has been the most successful of the known processes. In this process the contaminated metallic surfaces of the coolant circuits of nuclear reactors and the associated devices that have coolant flowing through them are first treated with an aqueous alkaline permanganate solution containing 3% potassium permanganate and 10% sodium hydroxide over several hours at a temperature in the region of 102°-110° C.; then, after rinsing with water an after-treatment process with a 10% aqueous solution of dibasic ammonium citrate is carried out, also over several hours and at a temperature of about 90° C. By means of the treatment with the permanganate solution, the chromium(III) oxide, which is contained in the contamination layer in a much enriched amount compared with the chromium content of the steel beneath the layer and which in this form is only dissolvable with great difficulty, is transformed into chromium(VI) oxide which is well soluble in aqueous alkaline solutions according to the reaction equation $$2MnO_4^- + Cr_2O_3 \rightarrow 2MnO_2 + Cr_2O_7^{--}$$

and then the chromium(VI) oxide together with other components of the contamination layer that are soluble in alkaline solutions are dissolved by the aqueous alkaline permanganate solution from the contamination layer, in the course of which the previously relatively solid structure of the contamination layer changes into a looser porous condition. The after-treatment with the reducing ammonium citrate solution following the removal of the permanganate solution and rinsing with water dissolves the remaining contamination layer from the steel lying beneath it, and with it, radioactive materials still contained therein and dissolves them in the ammonium citrate solution.

However, it is a disadvantage of this known contamination process that the alkaline permanganate solution is a concentrated alkaline solution and thus brings with it the risk of corroding the cooling system of the reactor. This danger of corrosion is of considerable significance since leakages in the cooling system of nuclear reactors resulting from corrosion can have very grave consequences, which are not restricted only to outflow of coolant containing radioactive materials but also, as is is known, may lead to a fusion of the whole reactor and melt-through of the protective concrete sheath of the reactor plant, the so-called GAU. As is also generally known, to prevent a catastrophe associated with a GAU, extensive emergency cooling equipments are built into the more modern reactor plants, which take over the emergency cooling of the reactor in the event of a leak in the cooling system. Understandably, however, an attempt is made to eliminate, as far as possible, even the risk of a leak arising in the cooling system, and this again leads to the attempt to limit the danger of corrosion in the course of decontamination to a minimum. Such a demand, however, mulitates against the use of highly concentrated oxidising or reducing solutions for decontamination so that lately, particularly after the appearance of small leaks in the cooling systems of nuclear reactors that have been in opertion for a long time, matters have gone so far as to require users to content themselves with no decontamination at all, or with decontamination carried out with hot water only, which is wholly unsatisfactory, purely to avoid all risks.

It is highly disadvantgeous in such a wholly unsatisfactory decontamination process that in the course of the necessary inspection work in the cooling system of the reactor the personnel carrying out the work is exposed to a high radiation dose which causes damage to health and which in addition requires the provision of a plurality of work gangs and the replacement of the work gangs after only a very short working period in order to limit the effective exposure to radiation of the individual work gangs.

The corrosion risk involved in the use of highly concentrated alkaline or acidic solutions for decontamination is partly also caused by the fact that the duration of action of the highly concentrated solution on the contaminated metal surfaces within a reactor coolant circuit varies according to the position of such surfaces, since both the filling of the cooling system with the highly concentrated solution and the draining of the solution from the system require a certain time, respectively. The duration of action of the solution on parts at the deepest positions of the cooling circuit, with which during filling it first comes into contact and with which it breaks contact last, is thus greater than the duration of action on parts at the highest positions of the cooling circuit, with which it comes into contact last during filling and with which it breaks contact first during drainage. Since a certain minimum duration of action is required for decontamination and if one observes thus a minimum duration of action also for the highest-lying parts of the cooling system without wishing to exceed it so as to avoid unnecessary corrosion risks, then the most deeply lying parts of the cooling system are exposed to a minimum duration of action that is longer than the filling and drainage times. In other words, it then depends how large is the sum of filling and drainage times in relation to the minimum duration of action. If the minimum duration of action is relatively large and the sum of filling and drainage times is thus small relative to the minimum duration of action then the durations of action of the solution for the highest and deepest positions of the cooling system are approximately equal and about equal to the minimum duration of action. In other words, in this case the risk of corrosion is limited because the solution exerts its effect during the minimum duration of action principally on the contamination layer and changes to acting on the metal lying beneath the contamination layer only after the minimum duration of action has elapsed. If, on the other hand, the minimum duration of action is relatively small so that the sum of the filling and draining periods is of the same order of magnitude as the minimum duration of action, then the duration of action of the solution at the most deeply-lying locations of the cooling system is a multiple of the minimum duration of action. In this case, significant corrosion damage may arise at the more deeply-lying regions of the cooling system because the solution begins to act on the metal lying beneath the contamination layer even before the end of the minimum duration of action, and then for corroding the metal lying beneath the contamination layer there is available a time period of the same order of magnitude as, or greater than, the minimum duration of action. Since the minimum duration of action decreases with increasing concentration of the solution employed, there exists a real risk of corrosion for the more deeply-lying regions of the cooling system when using highly concentrated alkaline or acidic solutions for decontaminating because of the aforesaid filling and draining times (or the result is, when allowing the highly concentrated solution to act on the more deeply lying areas of the cooling system for the minimum duration of action only and thus avoids this risk of corrosion, that at the higher-lying areas of the cooling system there is only a highly inadequate decontamination or in certain circumstances even none at all). In contrast, when using low concentration or dilute solutions with a minimum duration of action considerably longer than the filling and drainage periods, the risk of corrosion is almost completely avoided by making the time from the beginning of the filling to the end of draining equal to the minimum duration of action without having to accept insufficient decontamination in the higher areas of the cooling system.

The use of highly concentrated alkaline or acidic solutions for decontamination has, in addition to the above-described disadvantage of significant corrosion risk (and the resulting danger of leakages in the cooling system and all the attendant consequences), the further disadvantage that after drainage from the cooling system, the processing of the solution necessary to remove radioactive substances dissolved therein from the contamination layer during the decontamination procedure is considerably more complicated and thus costly for concentrated than for dilute solutions.

SUMMARY OF THE PRESENT INVENTION

The underlying task of the invention is to provide a decontamination process of the above-mentioned kind with which one can achieve a decontamination effect with low concentration solutions comparable with that of known decontamination processes, particularly the above-described currently most widely used "AP-Citrox" process, and at the same time, however the risk of corrosion bound up with the use of concentrated solutions is comprehensively excluded.

According to the invention this is achieved in a decontamination process of the above-mentioned kind by treating the contaminated metal surfaces with a 0.001 to 1 mol cerium salt solution containing at least one cerium (IV) salt and a water-containing (aqueous) solvent.

The water-containing solvent is preferably an aqueous solution of an acid of, generally, relatively low concentration. The concentration of acid in the cerium salt solution may correspond to e.g. the acid concentration in a 0.1–1 mol solution of this acid in water. Expediently, the concentration of acid in the cerium salt solution is at most the acid concentration in a 5 mol solution of this acid in water, in any case. The acid may advantageously be a mineral acid, preferably sulphuric acid or nitric acid.

However, the present invention also leads to relatively good results when instead of using an aqueous solution of an acid as solvent for the cerium(IV) salt, water alone is used, or when the concentration of acid in the water-containing solvent is zero. This fact is of particularly great significance, for the above-described reasons, for decontaminating of reactor coolant circuits with the aid of the present process. This is because it affords the possibility of using a very low (down to zero) concentration of acid used in conjunction with a very low concentration (down to 0.001 mol) of cerium salt solution in the water-containing solvent, which is possible in the present process, whereby to enable the use of an extraordinarily low concentration (dilute) solution for treating contaminated metal surfaces in reactor coolant circuits. In this way it becomes possible to overcome the above-illustrated corrosion problems arising in known decontamination processes and which problems, for safety reasons, led to the complete abandonment of the use of the known process.

In addition to the advantage that the present process can achieve surprisingly good decontamination results even with very dilute solutions, the present process has a whole series of further advantages over known decontamination processes, particularly that—in contrast to the above-mentioned process which is essentially restricted to permanganate for stainless steel—is very versatile in use and is e.g. successfully usable also for nickel-chromium alloys envisaged for future nuclear reactors. Also, in contrast to the above-mentioned permanganate process wherein the reaction of the permanganate with the chromium(III) oxide gives not only chromium(VI) oxide but also manganese oxide that is insoluble in water or aqueous solutions, in the present process no insoluble reaction products result and therefore by using the present process, the after-treatment with a reducing or complex-forming solution inevitably necessary in the above-described permanganate process to dissolve the manganese oxide can be obviated. This last-mentioned advantage is again also of considerable significance for decontaminating reactor coolant circuits, because it opens up the possibility of carrying out the decontamination solely with a relatively low concentration cerium salt solution. Also the after-treatment with reducing solutions which could, according to concentration, also involve problems of corrosion in the above-described sense, is obviated. The solubility of the reaction products arising from the treatment of contaminated metal surfaces with the cerium salt solution is also advantageous because thereby it becomes possible to carry out in a simple manner the separation of the cerium and radioactive substances in the used-up solution by suitable treatment, e.g. by electrolytic separation. In this way the cerium can be recycled and used for the preparation of a fresh treatment solution, and the used-up solution remaining after the separation of the cerium and the radioactive substances can without difficulty be removed in the same way as other industrial effluents.

Expediently, the treatment according to the present process takes place at a temperature lying between the freezing point and boiling point of the cerium salt solution, preferably in the range of 20° C. to 90° C.

If the contamination layer is of uneven thickness and/or the layer is removed unevenly during treatment, the cerium salt solution may with advantage be provided additionally with an inhibitor to prevent the metal from being dissolved at locations where it has already been freed from the contamination layer.

To achieve uniform removal of the contamination layer, it is further of advantage to produce a flow of the cerium salt solution relative to the contaminated metal surface and to maintain this flow preferably uninterruptedly during treatment. To maintain such a flow the cerium salt solution may expediently be circulated in a circuit. In this way, inter alia, the possibility arises of purifying the partially expended solution flowing off from the treated metal surfaces before it is passed to the treated metal surfaces again. Instead of maintaining a flow of cerium salt solution relative to the contaminated metal surfaces the removal of the contamination layer may also be achieved by setting the cerium salt solution into vibration; more particularly, the subjection of the cerium salt solution to sonic vibrations, preferably ultrasonic vibrations, has proved very advantageous in this connection.

After treatment with the cerium salt solution the metal surface is advantageously washed, preferably with water, to remove residue from the solution.

In cases where there are no reasons to the contrary, as may be the case e.g. in accordance with the foregoing explanations during the decontamination of reactor coolant circuits, in the present process also it may be recommendable to effect an after-treatment with a reducing or complex-forming solution, for which in principle the same solutions may be used as in the above-described permanganate process. Here, after treatment of the metal surface with the cerium salt solution and removal of the residue from the solution, preferably by washing with water, the surface is after-treated with a reducing or complex-forming solution, preferably with an aqueous solution of citrates or oxalates or ascorbates. The after-treatment may expediently be undertaken at temperatures in the range between the freezing and boiling points of the reducing or complex-forming solution, preferably at temperatures between 20° C. and 90° C. Following the after-treatment the metal surface is washed once again, preferably again with water, to remove remains of the reducing or complex-forming solution.

The invention also concerns the use of the present process for decontaminating contaminated surfaces of metals containing chromium and/or cobalt. A particularly advantageous use of the present process is for decontaminating contaminated surfaces of chrome steels and nickel-chromium alloys.

DESCRIPTION OF PREFERRED EMBODIMENTS AND EXAMPLES OF THE INVENTION

The mode of operation and practical results of the invention will now be described in detail by way of preferred embodiments.

In a manner similar to the above-described permanganate process, in the decontamination process of the present invention the contaminated metal surfaces are treated with a cerium salt solution, or stated more precisely, the Ce(IV) ions in this solution transform the insoluble metal oxides present in the contamination layer into metal oxides that are soluble in the cerium salt solution and thus can be dissolved out of the contamination layer on a chromium-containing metal, as e.g. a chrome steel which has hitherto been the main material used in reactor construction, or a nickel-chromium-titanium alloy envisaged for the planned high temperature reactors, then the contamination layer is principally enriched with insoluble chromium(III) oxide which changes over by the treatment with the cerium salt solution to the chromium(VI) oxide soluble in this solution and then the contamination layer can be dissolved out. The oxidation of the chromium(III) oxide to chromium (VI) oxide takes place according to the following reaction equation:

$$4\,H_2O + 6\,Ce^{4+} + Cr_2O_3 \rightarrow Cr_2O_7^{--} + 6\,Ce^{3+} + 8H^+$$

The reactions to change over other insoluble metal oxides present in the contamination layer to higher metal oxides take place in a similar manner, which higher oxides are soluble in the cerium salt solution and thus are dissolved out of the contamination layer during treatment. It is important in this connection that the reaction products of the above described reaction for the change or transformation of chromium (III) oxide to chromium (VI) oxide and corresponding reactions of other metallic oxides should all be soluble in the cerium salt solution, because this solubility of the reaction products is a decisive factor for the possibility already described above under the advantages of the present process, namely to treat the contamination layer solely with the cerium salt solution, i.e. without after treatment with acid or complex forming solutions so as to remove such layer practically fully from the treated metallic surface and to dissolve it in the treatment solution. In addition this solubility of the reaction products enables the used up treatment solution to be purified more simply.

In contrast thereto, and as described, the above explained permanganate process for changing chromium (III) oxide to chromium (VI) oxide results in manganese oxide which is an insoluble substance in the alkaline permanganate solution, and this precipitated manganese oxide is then only dissolved in the after-treatment in the reducing solution, so that in using the permanganate process an after treatment is practically indispensable. Beyond this and as also described already above in the permanganate process only the chromium (III) oxide oxidised to chromium (VI) oxide is removed from the contamination layer together with a few other components of the contamination layer soluble in alkaline solutions so that the components of the contamination layer which are soluble only in reducing solutions remain on the contaminated metallic surface after treatment with the permanganate solution, still in the form of the mentioned loose porous structure. These components of the contamination layer are then dissolved only in the after treatment with the reducing or complex forming solution and removed from the treated metallic surface. For this reason also an after-treatment is indispensable in using a permanganate process.

In contrast, in the present process and as already mentioned, the water-containing solvent for the cerium salt solution may be an aqueous solution of an acid and by suitably adjusting the concentration of the acid in the water-containing solvent it can be achieved that the above-mentioned components soluble only in reducing or complex-forming solutions can be dissolved from the contamination layer already during the treatment with the cerium salt solution, at least for the most part, so that an after treatment with the reducing or complex-forming solution in the present process may be completely dispensed with in certain circumstances. However, in every case, with the present process the concentration of a reducing or complex-forming solution used for a possible after-treatment is considerably lower than that used in the permanganate process which is of great significance for the already above-explained reasons particularly for the decontamination of reactor coolant circuits.

After treatment with the cerium salt solution the treated metallic surfaces are carefully washed with water in the present process. Great store is set by a good rinsing for the complete removal of residue of the treatment solution particularly in the use of the present process for decontamination of reactor coolant circuits because particularly in reactor coolant circuits remaining cerium residues can have a very unfavourable effect.

Following this rinsing any still remaining residue of the contamination layer may be removed by an after-treatment with the reducing or complex-forming solution. The same solutions are suitable for this after-treatment as are used in the permanganate process, thus e.g. aqueous solutions of citrates, oxalates or ascorbates; however, the concentration of these solutions may for the previously explained reasons be in general considerably lower than those used in the after-treatment following the permanganate process. The concentration of the solution required for the after-treatment according to the present process essentially depends on how high is the concentration of acid in the cerium salt solution. In the case of an extraordinarily low acid concentration in the cerium salt solution the required concentration of the solution to be used for the after treatment approximates to the concentration of the after-treatment solution in the permanganate process, and the higher the acid concentration in the cerium salt solution the lower may be the concentration of the solution to be used for the after-treatment following the treatment with the cerium salt solution.

For verifying and experimentally testing the present process a series of tests were carried out on test pieces within the frame of embodiments or examples of the present process and which will now be described to explain the invention in detail.

Test pieces of 20×20 mm were cut out from sheet metal of a thickness of about 1 mm and were provided in the centre with a hole of 2 mm diameter to enable them to be threaded on a retaining rod or retaining wire. A code number was stamped into each test piece to form the serial number of the test piece in question and from which the composition of the metal alloy of the test piece in question could be ascertained.

To remove contaminations, particularly machine oil or the like the test pieces were cleaned in an organic solvent and thereafter weighed accurately and the result of the weighing for each individual test piece was recorded.

About a half of each kind of test piece were so arranged in containers specially provided to this end that they did not touch each other and were secured against displacement relative to each other and so that a gas stream could flow through between the individual test pieces. The test pieces were next in these vessels subjected to a helium atmosphere with a concentration of contamination corresponding to the conditions one may expect in high temperature nuclear reactors to produce a pre-oxidation, and then both the pre-oxidized as well as the non-pre-oxidized test pieces were contaminated in a nuclear reactor over a time period of 60 days at an average temperature of 700° C., by inserting these test pieces into the reactor coolant system of a Dragon reactor at Winfrith, Great Britain which is a helium-cooled research reactor.

After this contamination, the contaminated test pieces were separated from each other in a remotely operable safety chamber and accommodated in individual small plastics sachets.

Next the radio activity of the radioactive isotopes accumulated on the test pieces was measured. The results of these measurements are set out in Table I below, more particularly in the form of radioactivity values in nCi/cm$^2$, which are average values for a total of 28 test pieces per surface unit of 1 cm$^2$ with a range of fluctuations in the test pieces set in question, giving the whole for each of the radioactive isotopes found in quantities worth mentioning as well as for the different alloys of which the test pieces were made and for the majority of these alloys for the non-pre-oxidized and pre-oxidized test pieces.

Table I

| Alloy | Radioactive isotopes | | | | |
|---|---|---|---|---|---|
| | $^{137}Cs$ | $^{134}Cs$ | $^{125}Sb$ | $^{54}Mn$ | $^{60}Co$ |
| TZM Plansee | 4.9 ± 1.1 | 4.3 ± 1.8 | 5.6 ± 1.2 | 9.4 ± 2.4 | 2.3 ± 0.7 |
| TZM Plansee pre-oxidised | 2.8 ± 0.4 | 2.4 ± 0.3 | 1.5 ± 0.3 | 11.7 ± 2.4 | 1.8 ± 0.3 |
| TZM Climax | 5.1 ± 0.8 | 3.9 ± 0.9 | 4.2 ± 0.8 | 10.6 ± 1.8 | 1.4 ± 0.4 |
| TZM Climax pre-oxidised | 4.4 ± 1.7 | 3.6 ± 1.2 | 2.8 ± 1.0 | 15.3 ± 6.0 | 2.2 ± 0.9 |
| X 10 CrNiTi 18 9 | 97 ± 12 | 69 ± 9 | 15.1 ± 3.8 | 23 ± 4 | 2.3 ± 1.0 |
| X 10 CrNiTi 18 9 pre-oxidised | 37 ± 31 | 25 ± 20 | 30 ± 5 | 28 ± 4 | 2.4 ± 0.4 |
| Nimocast 713 LC | 68 ± 15 | 51 ± 10 | 75 ± 7 | 30 ± 5 | 3.2 ± 0.9 |
| Hastelloy S | 78 ± 22 | 65 ± 17 | 12.7 ± 6.6 | 30 ± 4 | 3.1 ± 0.9 |

After this measurement of the radioactivity values the individual test pieces were next washed in water to remove the water-soluble parts of the contamination layer and then again accurately weighed to register for each individual test piece the change of weight caused by the above described process.

Then the radioactivity values of each individual test piece were measured again and from a comparison with the previously measured radioactivity values for the same test piece the decontamination factor achieved by washing off the water-soluble parts of the contamination layer was determined.

Next the test pieces were decontaminated by the present process as well as, for comparison purposes, in part by the above-described permanganate process (AP-Citrox process) wherein the decontamination was carried out according to the present process with different cerium salt solutions within the above specified range of cerium salt concentration (0.001-1 M cerium salt solution) in incremental cerium salt concentrations and always with different acids in the cerium salt solution as well as incrementally changed concentrations of these acids in the solution in order to determine the optimum cerium salt and acid concentrations as well as the most suitable acids.

In more detail, in this test series for the decontamination of test pieces in each case 6 test pieces were suspended on a Teflon support and brought into closable test tube containing the decontaminating solution. The closed test tube was then placed in a temperature-stabilized vibratory bath wherein the vibrations serve to simulate a liquid flowing around the test pieces and was kept in the bath for a predetermined time. Then the test tubes were taken from the bath, opened and then the Teflon support with the test pieces were pulled out and all the test pieces were rinsed in distilled water; finally they were dried in an oven at about 80° C.

The dry test pieces were then removed from the support and individually weighed to determined and record the change of weight due to the decontamination process that took place. From this change of weight the corrosion rate was ascertained and also recorded.

Finally the radioactivity values of the individual test pieces were once more determined and from the ratio of the radioactivity values before and after the decontamination process the decontamination factor was ascertained.

In the decontamination process of the test pieces according to the present invention relatively low concentration cerium salt solution was used by way of example, namely a 0.1 M cerium(IV) nitrate solution with pure water as solvent and the decontamination result achieved thereby was compared with the result of a decontamination process in accordance with the above-described permanganate process. The test pieces in both cases consisted of the same material, namely a Nimonic 80 A alloy and the same contamination conditions were present as well as the same pre-oxidation for one half of the pieces. In the decontamination process according to the present invention the contaminated test pieces were treated over 3 hours at a temperature of 80° C. with the mentioned 0.1 M cerium(IV) nitrate solution and then were after-treated for a further three hours and also at 80° C. with a complex-forming solution. During decontamination in accordance with the known permanganate process the treatment with the alkaline permanganate solution was carried out at the same temperature of 80° C. over the same time period of 3 hours and the after-treatment took place in exactly the same manner with the same solution as in the decontamination according to the present invention. The decontamination factors achieved for radioactive $Cs^{137}$− isotope in the present process for non-pre-oxidized test pieces gave a value of 90 and for pre-oxidized test pieces a value of 23; in the permanganate process the values for non-pre-oxidized test pieces was 290 and for pre-oxidized test pieces had in contrast a value of only 4. This example shows that the present decontamination process can lead to considerably better decontamination factors than the permanganate process under the same practical conditions in spite of the apparent superiority of the permanganate process which in theoretical supposition is apparently superior because it results in oxide-free pure metal surfaces but wherein practical conditions not sure but oxidised metal surfaces have to be reckoned with.

Furthermore, another comparison was made between the decontamination factors achieved by the known permanganate process and the present process which is significant in connection with the explanations set forth above concerning the risk of corrosion caused by highly concentrated treatment solutions. Reference has already been made there to the fact that the risks of corrosion caused by the highly concentrated treatment solutions such as the alkaline permanganate solution used in the known AP-Citrox process have in part led to a complete abandonment of the use of the decontamination processes. In Table II below a comparison is made between decontamination factors achieved with highly concentrated alkaline permanganate solutions and after-treatment with strongly reducing solutions according to the known AP-Citrox process, and those achieved by the present process with relatively dilute cerium salt solutions. Table II shows that, while eliminating the risks of corrosion caused by the hitherto used AP-Citrox process, still very considerable decontamination factors could be achieved which in one case, namely for the alloy Hastelloy S, were actually superior to that for the AP-Citrox process; and this was achieved notwithstanding the fact that the present process was carried out with cerium salt solutions of relatively low concentration and without any after-treatment. When comparing the decontamination factors given in Table II below, regard should accordingly be had, as explained above, to the fact that the actual comparison values for the decontamination factors achieved with the present process are of the order of 1, because the obviation of the danger of corrosion achieved by the present process could until now only be achieved by completely dispensing with decontamination in the known AP-Citrox process.

Table II

| Alloy | | Decontamination process | Decontamination factors | | | | |
|---|---|---|---|---|---|---|---|
| | | | $K_{Cs\text{-}137}$ | $K_{CS\text{-}134}$ | $K_{Sb\text{-}125}$ | $K_{Mn\text{-}54}$ | $K_{Co\text{-}60}$ |
| X10 CrNiTI 18 9 | pure | AP-Citrox | 850 | 620 | 6 | 224 | ∞ |
| | | Cerium salt | 60 | 80 | 21 | 85 | ∞ |
| X10 CrNiTi 18 9 | pre-oxidised | AP-Citrox | 135 | 90 | 3 | 295 | ∞ |
| | | Cerium salt | 30 | 40 | 5 | 40 | ∞ |
| Hastelloy S | | AP-Citrox | 675 | 535 | 9 | 285 | ∞ |
| | | Cerium salt | 680 | 530 | 10 | 290 | ∞ |

Finally, reference is made to the fact that the present decontamination process is not only usable for decontaminating reactor coolant systems but is also advantageously and successfully usable quite generally for the most various decontamination purposes, and e.g. also for the decontamination of conventional heating plants and heat exchangers. In all cases it is a particular advantage that the danger of corrosion always arising in known decontamination processes is obviated.

What I claim is:

1. A process for decontaminating metal surfaces of coolant circuits of nuclear reactors and associated equipment with surfaces are contaminated with radioactive contaminants, which comprises the steps of: contacting the contaminated metal surface with an aqueous solution consisting essentially of a 0.001 to 1.0 molar solution of at least one water-soluble cerium(IV) salt in water, at a temperature in the range of from the freezing point to the boiling point of the solution, and thereby dissolving the contaminants in said solution; then removing said solution from contact with said surface and then washing said surface with water to remove residues of said solution therefrom.

2. A process according to claim 1 wherein the temperature is in the range of from 20° C. to 90° C.

3. A process according to claim 1 wherein said solution contains an effective amount of a corrosion inhibitor for inhibiting dissolution of metal from areas which have been freed from contaminants.

4. A process according to claim 3 wherein after the washing step, said surface is contacted with a reducing or complex-forming solution, at a temperature in the range of from the freezing point to the boiling point of the reducing or complex-forming solution.

5. A process according to claim 4 in which said reducing or complex-forming solution is an aqueous solution of a citrate, oxalate or ascorbate.

6. A process according to claim 1 wherein after the washing step, said surface is contacted with a reducing or complex-forming solution, at a temperature in the range of from the freezing point to the boiling point of the reducing or complex-forming solution.

7. A process according to claim 6 in which said reducing or complex-forming solution is an aqueous solution of a citrate, oxalate or ascorbate.

8. A process according to claim 1 in which said cerium salt is cerium(IV) nitrate.

9. A process for decontaminating metal surfaces of coolant circuits of nuclear reactors and associated equipment which surfaces are contaminated with radioactive contaminants, which comprises the steps of: contacting the contaminated metal surface with an aqueous solution consisting essentially of a 0.001 to 1.0 molar solution of at least one water-soluble cerium(IV) salt in water containing acid in a concentration of up to 5 molar, at a temperature in the range of from the freezing point to the boiling point of the solution, and thereby dissolving the contaminants in said solution; then removing said solution from contact with said surface and then washing said surface with water to remove residues of said solution therefrom.

10. A process according to claim 9 wherein the temperature is in the range of from 20° C. to 90° C.

11. A process according to claim 9 wherein said solution contains an effective amount of a corrosion inhibitor for inhibiting dissolution of metal from areas which have been freed from contaminants.

12. A process according to claim 11 wherein after the washing step, said surface is contacted with a reducing or complex-forming solution, at a temperature in the range of from the freezing point to the boiling point of the reducing or complex-forming solution.

13. A process according to claim 12 in which said reducing or complex-forming solution is an aqueous solution of a citrate, oxalate or ascorbate.

14. A process according to claim 9 wherein after the washing step, said surface is contacted with a reducing or complex-forming solution, at a temperature in the range of from the freezing point to the boiling point of the reducing or complex-forming solution.

15. A process according to claim 14 in which said reducing or complex-forming solution is an aqueous solution of a citrate, oxalate or ascorbate.

16. A process according to claim 9 in which said acid is a mineral acid.

17. A process according to claim 9 in which said acid is nitric acid or sulfuric acid.

18. A process according to claim 17 in which said cerium salt is cerium(IV) nitrate.

19. A process according to claim 9 in which the concentration of said acid is at least 0.1 molar.

* * * * *

UNITED STATES PATENT AND TRADEMARK OFFICE

CERTIFICATE OF CORRECTION

PATENT NO. : 4 162 229

DATED : July 24, 1979

INVENTOR(S) : Hana Loewenschuss

It is certified that error appears in the above-identified patent and that said Letters Patent are hereby corrected as shown below:

Column 11, line 14; change "with" (first occurrence) to ---which---.

Signed and Sealed this

*Eleventh* Day of *December 1979*

[SEAL]

*Attest:*

SIDNEY A. DIAMOND

*Attesting Officer*

*Commissioner of Patents and Trademarks*